United States Patent [19]

Larsen et al.

[11] Patent Number: 4,919,233

[45] Date of Patent: Apr. 24, 1990

[54] FRONT RIDER LIFT TRUCK

[75] Inventors: Kurt K. Larsen; Pete Santiago, both of Pell City, Ala.

[73] Assignee: Blue Giant Equipment Corporation, Pell City, Ala.

[21] Appl. No.: 202,207

[22] Filed: Jun. 3, 1988

[51] Int. Cl.[5] ..... B66F 9/00

[52] U.S. Cl. ..... 187/9 R; 414/635; 414/914

[58] Field of Search ..... 414/628–638, 414/914; 296/102; 187/9 R; 180/252, 253

[56] References Cited

U.S. PATENT DOCUMENTS

| | | | |
|---|---|---|---|
| 2,169,440 | 8/1939 | Weiss | 414/634 X |
| 2,287,469 | 6/1942 | Cochran | 414/630 |
| 2,362,129 | 11/1944 | Gfrorer | 414/634 |
| 2,618,396 | 11/1952 | Belt | 414/633 |
| 2,639,829 | 5/1953 | Dempster et al. | 414/634 X |
| 3,216,599 | 11/1965 | Hopfeld | 414/634 |
| 3,225,949 | 12/1965 | Erickson et al. | 414/629 |
| 3,563,401 | 2/1971 | Gandolfo | 414/634 |
| 4,365,921 | 12/1982 | Brouwer et al. | 414/629 X |

*Primary Examiner*—David A. Bucci

*Attorney, Agent, or Firm*—Jennings, Carter, Thompson & Veal

[57] ABSTRACT

A rider truck lift utilizes a see-through mast assembly and a forwardly positioned rider compartment to improve visibility of the load for the operator. The rider compartment is accessible from either side of the truck and comprises a low-rise deck which allows for one-step ingress and egress. A pseudo-tricycle wheel arrangement provides for a tandem articulated rear wheel steering assembly that reduces tire wear and improves maneuverability.

4 Claims, 4 Drawing Sheets

FRONT RIDER LIFT TRUCK

FIELD OF THE INVENTION

The present invention relates to the field of lift trucks or fork lifts as they are sometimes called and in particular to such devices whereon the operator rides on the lift truck and controls its operation from thereon. More particularly the present invention relates to a rider lift truck which places the rider at the most advantageous work location proximal the load.

BACKGROUND OF THE INVENTION

Numerous examples of lift trucks and fork lifts are well known in the art. There are various rider trucks and riderless trucks which utilize the forward prongs as a lift. Of the rider trucks, two main varieties are well known: one is a four-wheeled vehicle having a rider's seat mounted atop the motor and hydraulic system, the second is a smaller lift truck with the rider standing on a platform at the rear of the truck. Neither of these types of prior art lift trucks take into account the changing environment in the industrial materials handling operation. The advent of computerization and the "just in time" inventory philosophy have made inventories a liability rather than an asset, have changed the distribution and storage patterns to the extent that the trailer loads of yesteryears which went to a single point have been changed to smaller lot shipments, and split loads with many-fold deliveries in a single trailer. Consequently, the lift truck operator's job has changed from a "sit down" job where he moved pallet after pallet without getting off his machine to an "on and off" job where he must frequently get off the machine and attend to the load. Furthermore, the smaller shipments result in smaller storage space with smaller aisles, thus greater mobility and visibility are required in today's environment.

SUMMARY OF THE INVENTION

It is an object of the present invention to provide a lift truck specifically adapted to the handling of the type loads in today's environment.

Yet another object of the invention is to provide the rider with the best visibility in a lift truck.

Still another object of the invention is to provide a lift truck that is highly maneuverable.

A further object of the present invention is to minimize the effort required by the rider to get from his operating position to the load.

These and other objects and advantages are accomplished in our improved lift truck as described hereinafter. Our lift truck improves the rider's visibility by placing him immediately adjacent the load. This also enhances his ability to quickly access the load because in our design the rider is free to enter or exit the lift truck from either side via a low step. Thus, he does not have to climb on to or off of the truck or walk around the truck to get from the load to his operating position. Each of these is accomplished in our unique design which incorporates an operator deck immediately adjacent the load, being separated therefrom only by a forward shield to which the vehicle controls are mounted. The operator deck is open on both sides and bounded rearwardly by a battery compartment which extends transversely behind the operator.

A pair of spaced apart forward wheels provide drive power, while a twin wheel steering wheel assembly yields a pseudo-tricycle steering capability enhanced by a power steering system.

BRIEF DESCRIPTION OF THE DRAWINGS

Apparatus embodying features of my invention are depicted in the accompanying drawings which form a portion of this invention and wherein.

DESCRIPTION OF A PREFERRED EMBODIMENT

Figure 1:
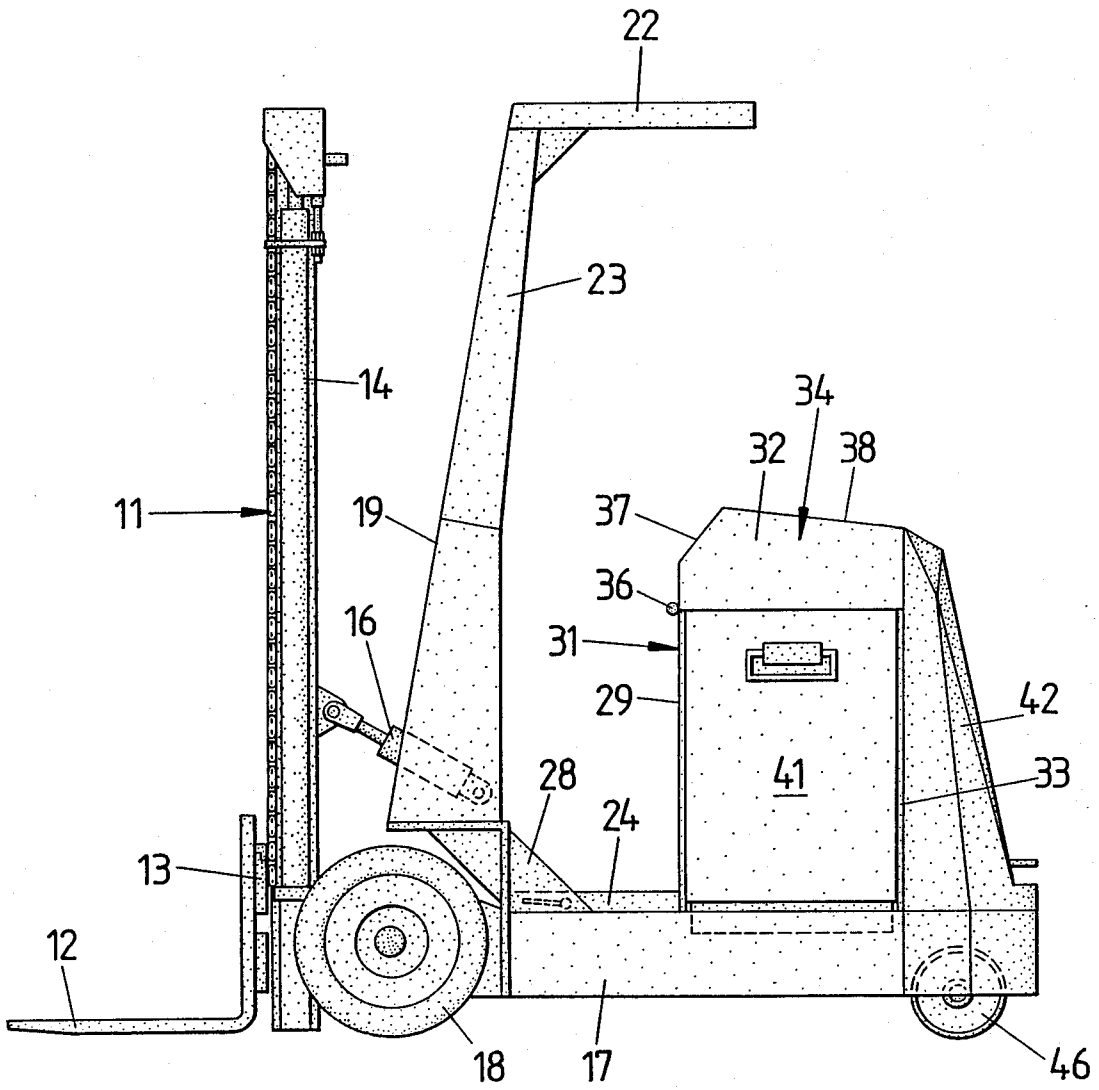
FIG. 1 is a side elevation of the rider truck.

Referring to the drawings for a clearer understanding of the invention, it should be immediately apparent that the present invention is specifically designed to place the rider in the most advantageous position relative to the load. The load is raised, carried and lowered on the mast assembly 11, which includes the forks 12, fork carriage 13, lift cylinder 14, tilt cylinder 16 and assorted chains and connecting and frame members. As will be noted in FIG. 2, the mast assembly 11 is designed with the hydraulic lift cylinder 14 and lifting chain spaced apart to provide direct frontal visibility of the load and forks 12.

The mast assembly 11 is mounted to a chassis assembly 17 which forms a basis for the remainder of the body assembly. A pair of spaced apart front wheels 18 are mounted at the front of the chassis assembly 17 proximal the mast assembly 11. Preferentially the forward drive wheels 18 are driven by a REGAL LINE TM Rigid Drive Axle made by Rockwell (not shown) powered by a 36 volt electric motor (not shown) which is located within the chassis assembly 17.

A forward shield 19 extends from the chassis assembly substantially above the drive wheels and includes an operator's console 21. The shield 19 is open above the console 21 and includes an overhead guard 22 supported by a pair of lateral posts 23. Immediately to the rear of the shield 19 and supported by the chassis assembly 17 is a rider's deck 24 which is a two level deck having a raised central portion 26 and a pair of lateral portions 27. A pair of gussets 28 affixed to the outer forward edges of the deck 24 at the bottom of the shield serve as toe guards.

The remainder of the body assembly is mounted on the chassis assembly 17 to define a rider compartment subtended by the shield 19, the deck 24, and a forward wall 29 of a battery compartment 31. The battery compartment 31 extends transversely of the chassis assembly and is defined by the forward wall 29, a pair of upper sidewalls 32, a rear wall 33 and a cover 34 mounted to the forward wall 29 by a hinge 36. The sidewalls 32 are trapezoidal in shape and rise to a peak near their junction with the forward walls 29. The cover 34 conforms to the upper profile of the sidewalls 32 and thus includes an upwardly and rearwardly inclined portion 37 extending from the hinge 36 to the peak of the sidewalls 32 and downwardly and rearwardly sloping portion 38. The forward wall 29 is of such a height that inclined portion 37 provides a pseudo seat against which the rider may lean to relieve his legs.

The inclination of the portion thus provides a degree of support to the rider. A 36 volt battery pack 41, commonly used in lift trucks, is placed in the battery compartment 31. Note that the massive battery pack 41 now has a substantial moment arm from the front axle as compared to the mast assembly and thus provides a great improvement in counter-balancing the load as compared to previous rider trucks.

Figure 2:
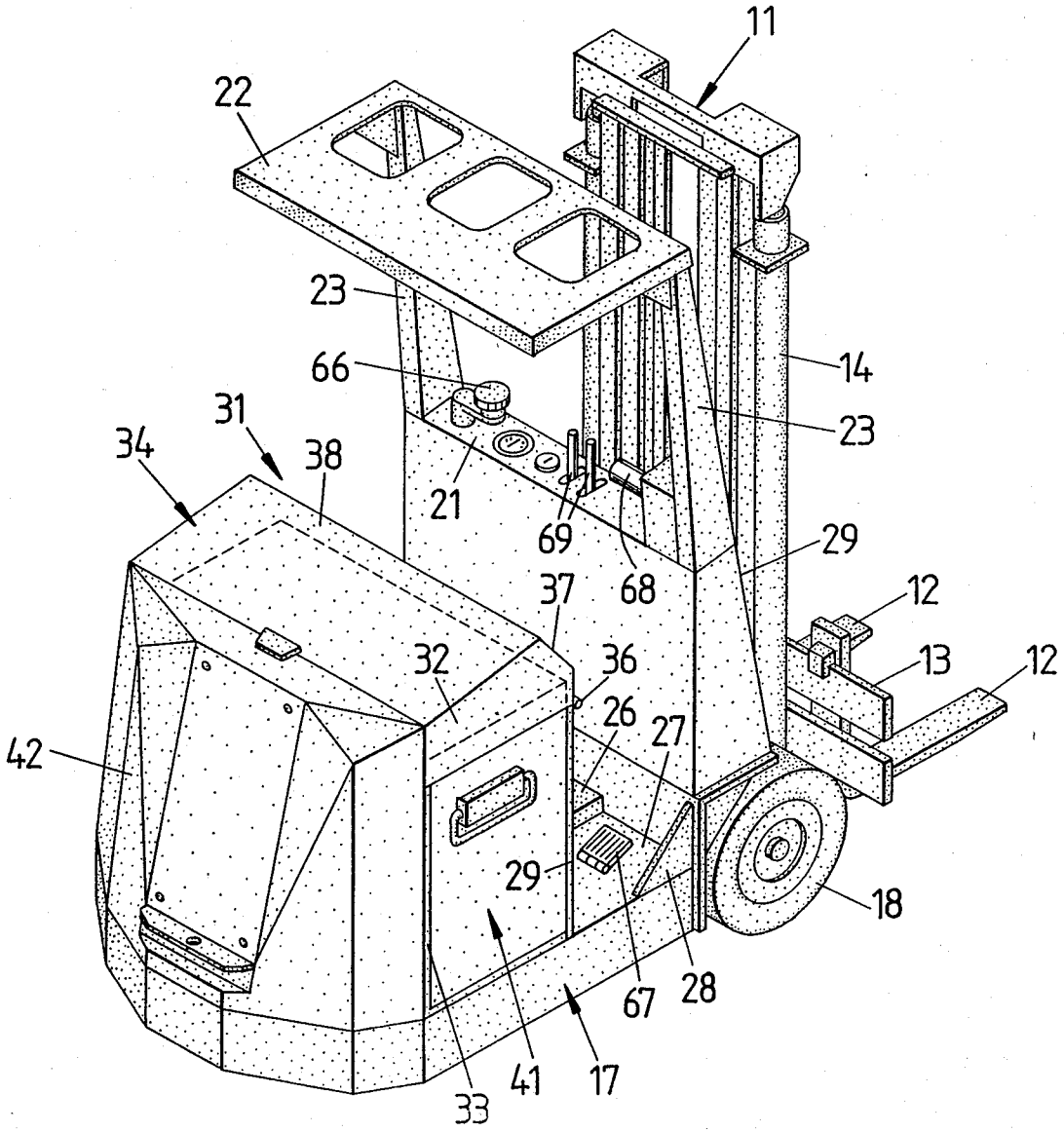
FIG. 2 is a perspective view of the rider compartment.
Figure 4:
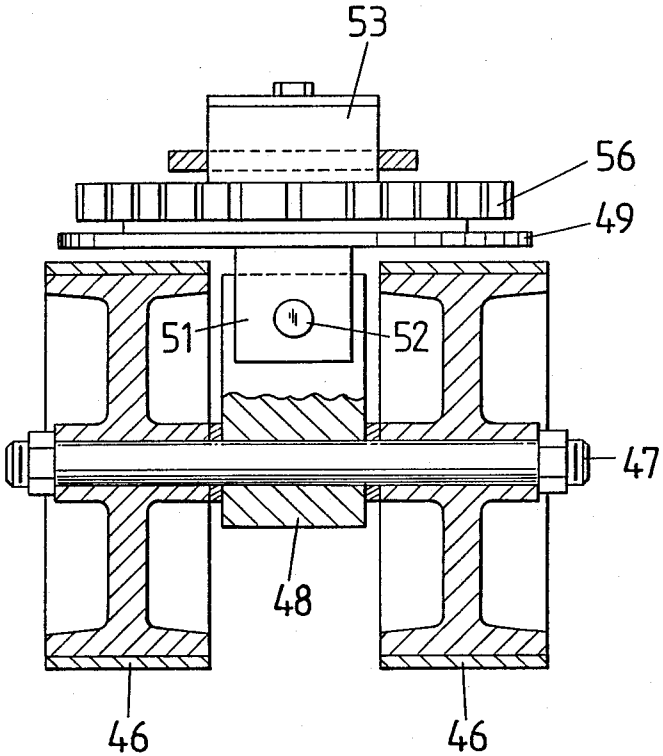
FIG. 4 is a sectional view of the steering wheel assembly.
Figure 3:
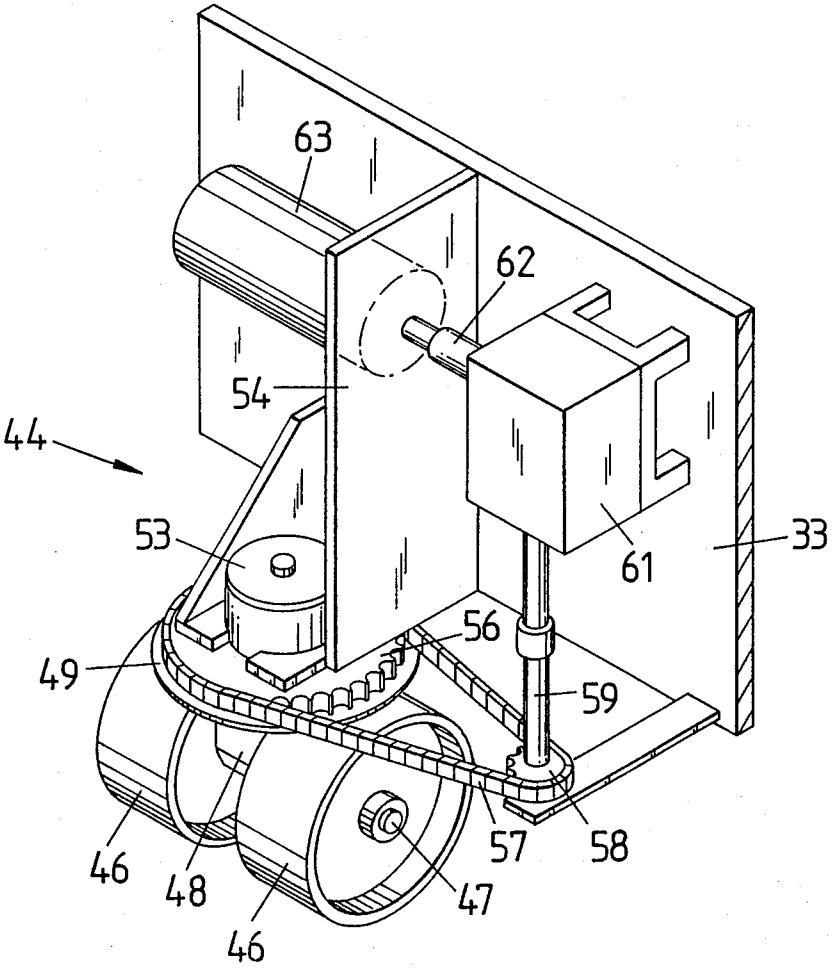
FIG. 3 is a detail view of the steering mechanism.

Rearwardly of the battery compartment 31 is a steering assembly housing 42. The steering assembly housing 42 and chassis assembly 17 are both shaped to minimize the rear dimension of the lift truck and thus provide greater maneuverability. Another key to the enhanced maneuverability is the steering assembly 44 itself which is shown in FIGS. 3 & 4. As may be seen, the steering assembly 44 includes a pair of wheels 46 mounted for free rotation on a common axle 47 mounted in a block 48 which is secured to the bottom of a steering disc 49 with a clevis connection 51 having a clevis pin 52 at right angles to the axle 47. The steering disc 49 is mounted for rotation as within a thrust bearing 53 mounted to the chassis assembly or a mounting frame 54 attached to the rear wall 33. The steering disc 49 is provided with a peripheral sprocket 56 which engages a drive chain 57 which extends around a drive sprocket 58 mounted on a drive shaft 59 extending from a gear box 61. The gear box is connected to an output drive shaft 62 from a variable speed electric motor 63 which is controlled by a transistorized electronic interface (not shown) with a steering handle 66 mounted on the console 21 as shown in FIG. 2. Thus the rider can control the steering assembly with fingertip pressure applied to handle 66. Note that the unique design of the dual wheel steering assembly also reduces scarring of the floor as is common with single wheel trucks. In the present design, rotation of the steering disc causes one of the wheels 46 to rotate clockwise while the other rotates counterclockwise, thus the only frictional forces generated between the wheels 46 and the floor are rolling friction rather than sliding friction. Accordingly the truck is much more maneuverable and tire wear is greatly reduced.

Figure 5:
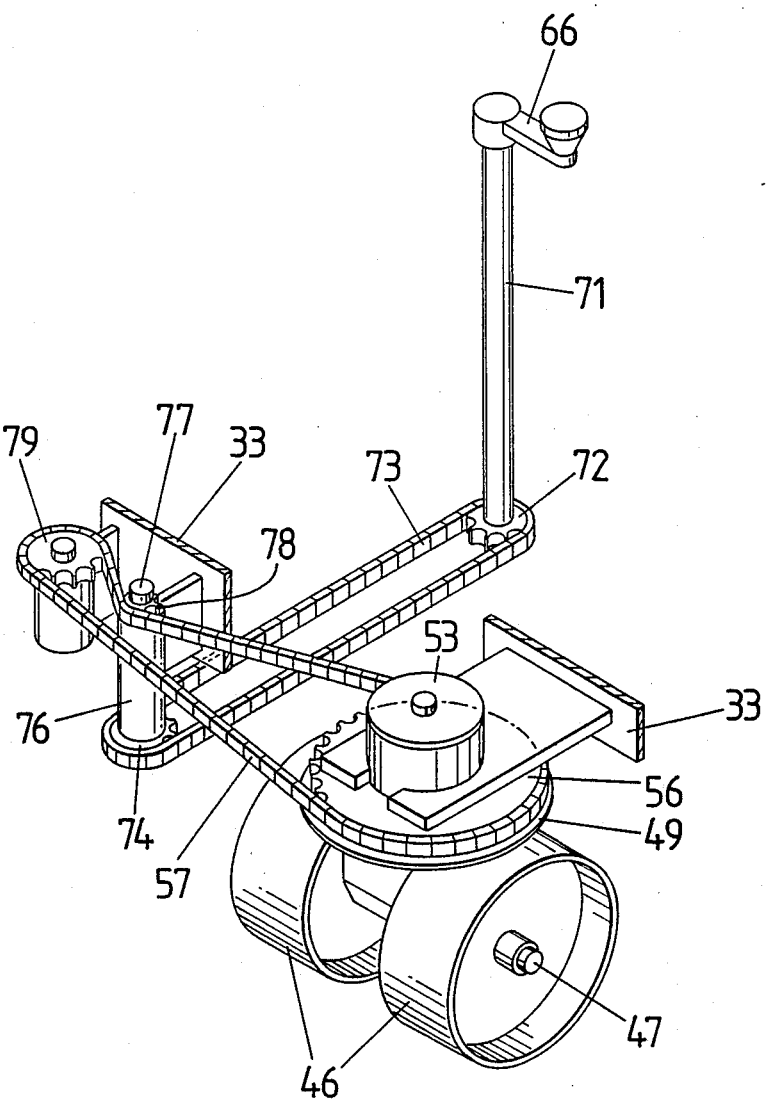
FIG. 5 is a perspective view of a second embodiment of the steering wheel assembly.

In a second embodiment of the steering assembly, shown in FIG. 5, a mechanical linkage connects steering handle 66 to the steering disc 49. The mechanical linkage includes a handle shaft 71 mounted for rotation within console 21 and supporting steering handle 66 at its upper end and a sprocket 72 at its lower end. The sprocket 72 engages a steering chain 73 which runs rearwardly beneath the deck 24 to a second sprocket 74 mounted to rear wall 33 in a sleeve 76. A shaft 77 connects second sprocket 74 to a transfer sprocket 78 which engages drive chain 57 which extends around the peripheral sprocket 56 and an idler sprocket 79.

The weight of the truck including the battery pack is supported intermediate the front and rear wheels and is evenly distributed laterally, thus the pseudo-tricycle configuration is both laterally and longitudinally stable. Additional safety features include a dead man brake pedal 67 on the deck 24 which must be depressed to operate the truck. Speed control and the forward and reverse direction of the truck is controlled with a twist grip throttle 68 on console 21. The lift cylinder 14 and tilt cylinder 16 are controlled with levers 69 mounted on the console 21.

As may be seen the rider compartment can be easily accessed from either side. With ten inch diameter steering wheels 46 and 18 inch diameter drive wheels 16, the rider deck 24 is only eleven inches off the floor, thus the rider can easily dismount to service the load and then merely step back into his truck.

From the foregoing, it may be seen that we have devised a highly maneuverable and readily accessible lift truck which also provides greater safety to the rider and is ideally suited to the modern industrial materials handling operation.

While we have shown our invention in two forms, it will be obvious to those skilled in the art that it is not so limited but is susceptible of various changes and modifications without departing from the spirit thereof.

What we claim is:

1. A lift truck comprising:

(a) a mast assembly including a set of vertically movable lifting forks;

(b) a body assembly operatively connected to support said mast assembly, (c) a battery compartment having a front wall extending upward from a body assembly, a rear wall extending upwardly from said body assembly, and co-extensively with said front wall, a cover member having a pair of sidewalls each of which has a non-linear upper edge and extends from a top corner of said front wall to a co-extensive top corner of said rear wall, and a top member hingedly mounted to said front wall and extending upwardly then rearwardly engaging said sidewalls along the non-linear upper edge and providing a support member against which the operator may rest, said battery compartment also having open sides perpendicular to said front and rear walls providing access to the compartment;

(d) battery means extending coextensively with said compartment for providing electric power and a counter balance to said lift forks;

(e) a shield having a console and an overhead guard supported by lateral posts; said body assembly supporting said mast assembly with said battery compartment extending transversely thereof and said shield extending transversely of said body assembly proximal said mast assembly with said battery compartment and said shield spaced apart to form a rider platform therebetween with said rider platform being accessible from either side of said body assembly;

(f) a pair of spaced apart drive wheels mounted to said body assembly beneath said forward shield;

(g) a steerable rear wheel assembly mounted to said rearwall proximal the centerline thereof rearwardly of said battery compartment;

(h) a housing extending about said steerable rear wheel assembly from said body assemble to said rear wall; and, (i) means for steering said rear wheel assembly.

2. The lift truck as defined in claim 1 wherein said steerable rear wheel assembly comprises a vertical shaft rotatably mounted to said body portion, an axle mounted transversely to said shaft, and a pair of freely rotatable wheels mounted on said axle equidistant from and proximal said vertical shaft.

3. The lift truck as defined in claim 2 wherein said means for steering comprises:

(a) a sprocket member affixed to said vertical shaft and rotatable concomitantly therewith;

(b) a variable speed electric motor having a rotatable output shaft; and (c) means for connecting said output shaft to said sprocket.

4. The lift truck as defined in claim 1 wherein said rider platform includes a raised central portion extending between said forward shield and said battery compartment and a lower lateral step-like portion on each side thereof.

* * * * *